US006249208B1

(12) United States Patent
Proks et al.

(10) Patent No.: US 6,249,208 B1
(45) **Date of Patent: *Jun. 19, 2001**

(54) CHIP INDUCTANCE

(75) Inventors: Gerhard Proks, Steinheim; Elmar Walter, Heidenheim; Hans-Dieter Eckardt, Herbrechtingen; Manfred Espenhain, Heidenheim; Jörg-Rudolf Maier, Heidenheim; Kurt Marth, Heidenheim; Wilfried Scherer, Heidenheim, all of (DE)

(73) Assignee: Siemens Matsushita Components GmbH & Co. KG, Munich (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/367,733

(22) PCT Filed: Mar. 19, 1998

(86) PCT No.: PCT/DE98/00812

§ 371 Date: Aug. 18, 1999

§ 102(e) Date: Aug. 18, 1999

(87) PCT Pub. No.: WO98/44518

PCT Pub. Date: Oct. 8, 1998

(30) Foreign Application Priority Data

Mar. 27, 1997 (DE) ..... 197 13 147

(51) Int. Cl.[7] ..... H01F 27/26; H01F 5/00

(52) U.S. Cl. ..... 336/210; 336/192; 336/200

(58) Field of Search ..... 336/210, 192

(56) References Cited

U.S. PATENT DOCUMENTS 5,266,739 11/1993 Yamauchi .

FOREIGN PATENT DOCUMENTS 35 10 638 C1 10/1986 (DE) .
44 32 740 A1 3/1996 (DE) .
0 212 812 A1 3/1987 (EP) .
2 606 544 A1 5/1988 (FR) .

OTHER PUBLICATIONS

Patent Abstracts of Japan: JP 06–314618, Nov. 8, 1994.

Patent Abstracts of Japan: JP 58–223306, Dec. 24, 1983.

*Primary Examiner*—Anh Mai
(74) *Attorney, Agent, or Firm*—Schiff Hardin & Waite

(57) ABSTRACT

A chip inductance is composed of a wound coil core (1) that is arranged erect on a system carrier (6). Perpendicularly residing clips (7) are located on the system carrier, whereby the coil core (1) is arranged within the space formed by the clips. The terminals are thereby located essentially outside the space existing between the end face planes of the coil core (1).

10 Claims, 1 Drawing Sheet

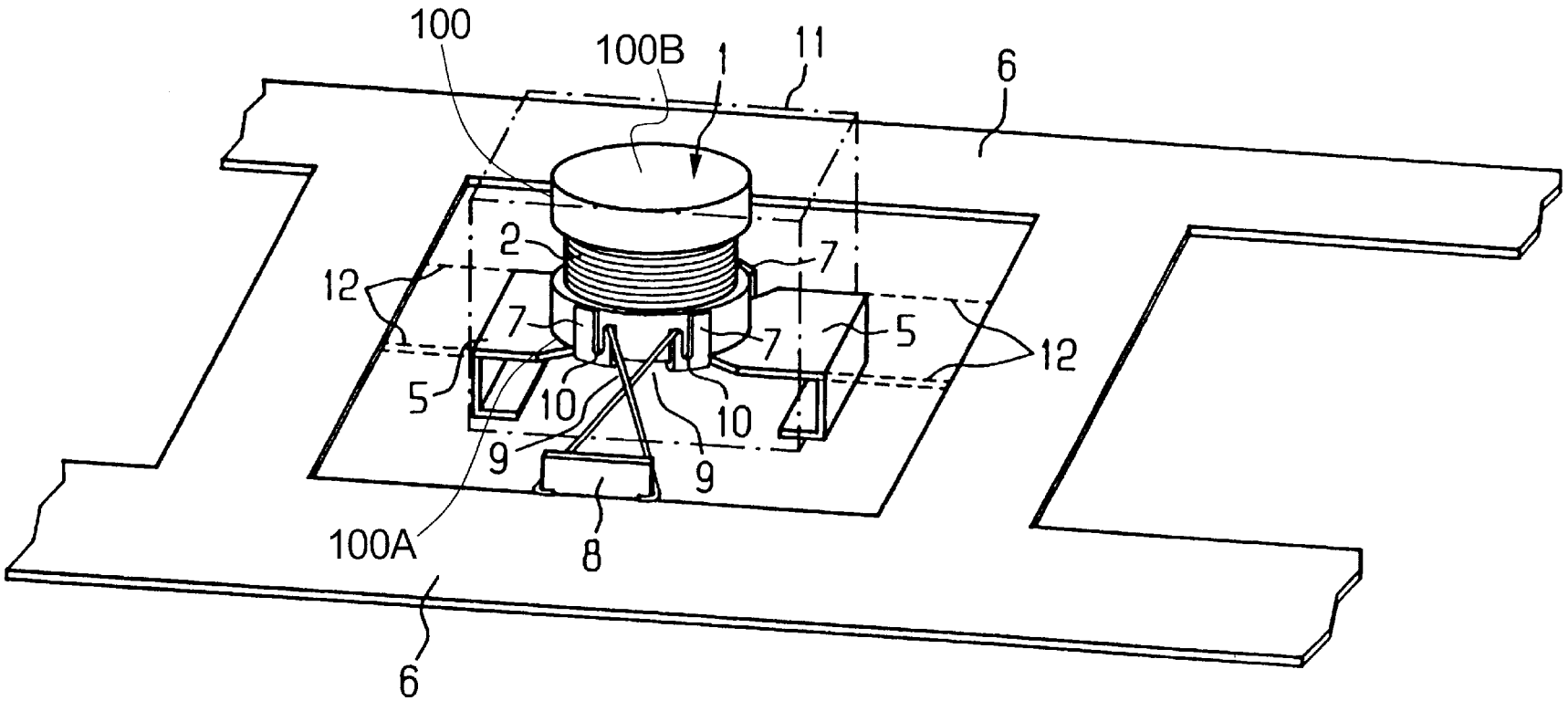
6
11
100
100B
1
2
7
7
5
12
12
5
10
10
9
9
8
100A
6

CHIP INDUCTANCE

BACKGROUND OF THE INVENTION

The invention is directed to a chip inductance having a wound coil core that is arranged erect on terminal surfaces that are part of a system carrier.

Such a chip inductance is disclosed by European reference EP 0 212 812 A1. The embodiment wherein the end face of the core at the motherboard side and the terminal parts lie in the system carrier plane, is characterized in that the influence of the metallic system carrier parts on the electromagnetic field produced by the coil is reduced. However, it is difficult to position the coil core and the electrical contact locations with adequate precision on the system carrier terminals.

The prior art European reference proposes a solution with terminal clips, whereby the coil cores are glued into depressions such that the end faces of the cores at the motherboard side are below the system carrier plane. Although a better positioning precision is thereby achieved, this is acquired at the expense of a certain deterioration of the electrical properties.

German reference DE 35 10 638 C1 also discloses an inductive miniature component wherein a wound ferrite core is placed onto a system carrier with terminal clips and is glued thereto. Measures for positioning the ferrite core are not taught by this German reference.

It is therefore an object of the present invention to improve the chip inductance such that a better positioning precision of coil core and electrical contacts on the terminals is achieved without deteriorating the electrical properties.

This object is inventively achieved in that the terminal surfaces comprise clips with which the coil core is positioned and fixed, and that serve for the electrical connection of winding end terminals; in that the clips of the coil core are located within a space that is present between the face planes of the coil core; and in that the remaining parts of the terminals are arranged outside this space.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawing, and in which:

The single FIGURE depicts a chip inductance according to the present invention.

DESCRIPTION OF THE PREFERRED EMBODIMENTS

The single FIGURE shows the coil core 1 with winding 2 arranged thereon. The coil bod 1 has its end face at the motherboard side on terminal surfaces 5 that are part of a system carrier 6 composed of sheet metal.

Perpendicularly residing clips 7 are arranged on the terminal surfaces 5, so that a space is formed that serves the purpose of positioning the coil core 1. The fastening of the coil core 1 occurs with glued connections between end face of the coil body at the motherboard side and the terminal surfaces on the one hand and between the clips 7 and the core 1 on the other hand. The coil body 100 also has a top end face 100B.

During winding, the winding tension causes a bending of the terminals 5 as a consequence of their elasticity. Particularly given thick wire windings having winding wire diameters of, for example, 0.3 mm, tumbling motions of the coil core 1 result that preclude precise winding formats and, consequently, lead to increased scatter of the electrical coil data, in order to obtain precise and reproducible winding formats, the terminals, in order to reduce core tumbling, must be prevented from moving as close as possible to the core 1.

Given the embodiment disclosed by European reference EP 0 212 812 A1, the neighboring coil bodies are connected to one another by the system carrier for automated fabrication, whereby two winding supporting points per coil core are located on the system carriers. The winding wire sections between guide clips and the winding supporting points lie on the terminals in the system carrier plane after the winding, these being fashioned perpendicular to the system carriers. Hold-down means at both sides of the system carrier would be required for this purpose, whereby, however, the winding wire sections proceeding over the terminals as well as the winding supporting points would represent an impediment. Further, the known embodiment requires a two-sided, mechanical cutting of the winding wire sections that are not required for the application.

In the subject matter of the application, the automated fabrication likewise ensues with the system carriers 6 on which, however, only one winding supporting point 8 is located per coil core 1. The winding wire sections 9 between the clips 7 and the winding supporting point 8 do not lie on the terminals in the system carrier plane after winding, these being fashioned parallel to the system carriers 6.

Given this terminal and system carrier design, hold-down means for the thick wire windings can be realized from one side of the system, so that the winding sections 9 and the winding supporting point 8 are not located in the working area of the hold-down means. Furthermore in the embodiment of the invention, further, only a single-sided cutting of the unrequired winding wire sections 9 is required.

The embodiment of the invention therefore leads to tighter tolerances of the electrical coil data as a result of more reproducible winding formats and leads to simpler cutting of the access winding wire.

Welded connections are required for employment at elevated temperatures such as, for example, in motor electronics since they are more temperature-stable then solder connections.

There has hitherto not been a suitable welding process for automated fabrication of chip inductances with thick wire winding.

A direct welded connection with the known ultrasound process involves clock times of approximately one second and therefore leads to high manufacturing costs.

No manufacturing method has yet been developed for a direct welded connection by laser that, for example is disclosed by German reference DE 40 39 527 C1.

The indirect laser welding disclosed by German reference DE 44 32 740 A1 cannot be implemented given a thick wire winding since the spring-back of the winding wire at the moment of melting leads to interruptions or to inadequate welded connections.

The clips 4 that improve the positioning of the coil core 1 and the adhesive strength are fashioned partly with and partly without winding hooks. With winding hooks, they additionally serve as electrical terminals positioned with low tolerances. For thick wire windings, those clips 4 at which the electrical connection from winding end and terminal ensues through slots 10 are divided in two, whereby the sub-clips connected to the winding 2 prevent the unraveling of the winding wire since they are not melted, whereas the sub-clips connected by the winding wire section 9 to the winding support point 8 supply the material for the welding beads given indirect laser welding according to German reference DE 44 32 740 A1.

The embodiment of the invention thereby enables the indirect laser welding of thick wire windings having, for example, a wire diameter of 0.3 mm.

After the winding of the coil core 1 has been completed and after the fastening of the winding wire ends 9 to the corresponding clips 7, an enveloping with plastic 11, for example with a liquid-crystalline polymer, ensues.

After the envelope 11 has been produced, the chip inductances are separated in that the terminals 5 are separated from the system carrier 6 at the broken lines 12. The electrical terminals that are required for soldering into motherboards are produced by bending the terminals 5 over onto the envelope 11.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A chip inductance having a coil core having a winding, the coil core being arranged upright on terminal surfaces that are part of a system carrier, the chip inductance comprising:

the terminal surfaces having upwardly extending clips with which the coil core is positioned and fixed and which also provide electrical connection to ends of the winding;

the clips and the coil core located within a space that exists between two infinitely elongated planes defined by the plane end faces of the coil core; and all remaining parts of the terminal surfaces, other than the clips, being arranged outside of the space.

2. The chip inductance according to claim 1, wherein the coil core is secured on the system carrier with a glued connection.

3. The chip inductance according to claim 1, wherein winding ends of the winding are connected to the clips lying against the coil core with indirect laser welding.

4. The chip inductance according to claim 3, wherein the clips connected to the winding ends are composed of two parts; and wherein one part of said two parts supplies material for a welding bead.

5. The chip inductance according to claim 1, wherein the chip inductance is mounted on a system carrier with the terminals parallel to a longitudinal direction of the carrier, said system carrier having only one winding supporting point per chip inductance.

6. A chip inductance, comprising:

a system carrier having terminal surfaces;

a coil core having a winding with winding ends, the coil core located upright on the terminal surfaces;

the terminal surfaces having upwardly extending clips with which the coil core is positioned and fixed and which also provide electrical connection to ends of the winding;

the coil core having two end faces that define two infinitely elongated planes having a space therebetween;

the clips and the coil core being located within the space and all remaining parts of the terminal surfaces, other than the clips, being located outside of the space.

7. The chip inductance according to claim 6, wherein the coil core is secured on the system carrier with a glued connection.

8. The chip inductance according to claim 6, wherein the winding ends are connected to the clips via indirect laser welding.

9. The chip inductance according to claim 8, wherein a part of the clips connected to the winding ends supplies a material for a welding bead.

10. The chip inductance according to claim 6, wherein the chip inductance is mounted on a system carrier with the terminals parallel to a longitudinal direction of the carrier, said system carrier having only one winding supporting point per chip inductance.

* * * * *